US007674002B1

(12) United States Patent
Wang

(10) Patent No.: US 7,674,002 B1
(45) Date of Patent: Mar. 9, 2010

(54) SOLAR UMBRELLA CLIP LIGHT

(75) Inventor: Shooupyng Wang, Ft. Lauderdale, FL (US)

(73) Assignee: Chien Luen Industries Co., Ltd., Inc., Oakland Park, FL (US)

( * ) Notice: Subject to any disclaimer, the term of this patent is extended or adjusted under 35 U.S.C. 154(b) by 84 days.

(21) Appl. No.: 11/796,024

(22) Filed: Apr. 26, 2007

(51) Int. Cl.
*F21L 4/00* (2006.01)

(52) U.S. Cl. ..... 362/183; 362/102; 362/170; 362/173; 362/182; 362/188; 362/191; 362/194; 362/199; 248/231.51; 248/231.71; 248/231.81; 248/316.5; 248/689

(58) Field of Classification Search ..... 362/102, 362/170, 173, 182, 183, 188, 191, 194, 199; 248/231.51, 231.71, 231.81, 316.5, 316.7, 248/689

See application file for complete search history.

(56) References Cited

U.S. PATENT DOCUMENTS

| | | | | |
|---|---|---|---|---|
| 4,392,187 | A * | 7/1983 | Bornhorst | 362/233 |
| 5,055,984 | A * | 10/1991 | Hung et al. | 362/183 |
| 6,619,813 | B1 * | 9/2003 | Schnell | 362/116 |
| 6,837,255 | B2 | 1/2005 | Bunch et al. | 3/4 |
| 7,000,624 | B2 | 2/2006 | Chang | 135/16 |
| 2002/0074027 | A1 | 6/2002 | Maidment | 3/2 |
| 2002/0131263 | A1 * | 9/2002 | Naghi et al. | 362/98 |
| 2003/0008720 | A1 * | 1/2003 | Wheat | 473/182 |
| 2004/0020522 | A1 | 2/2004 | James | |
| 2004/0228124 | A1 * | 11/2004 | Reiff et al. | 362/184 |
| 2006/0219472 | A1 * | 10/2006 | Vance | 181/131 |
| 2006/0227540 | A1 | 10/2006 | Sohn | 362/157 |
| 2007/0109768 | A1 * | 5/2007 | Sohn | 362/106 |
| 2007/0212931 | A1 * | 9/2007 | Livingston | 439/501 |
| 2007/0242450 | A1 * | 10/2007 | Blatecky | 362/102 |

* cited by examiner

*Primary Examiner*—Sharon E Payne
*Assistant Examiner*—Mary Zettl
(74) *Attorney, Agent, or Firm*—Brian S. Steinberger; Law Offices of Brian S. Steinberger, P.A.

(57) ABSTRACT

Portable solar powered light sources, devices, apparatus, systems and methods of attaching and using the light source. The light sources can have a single small housing having an upper roof portion with an exposed solar cell, a photocell activator, and small housing. The housing can have two parts that pivot with one another so that a front end of the housing can be biased together by a spring, and the rear side having edges that are spaced apart. An operator can press the rear spaced apart edges together, to open the front end to slide about a support structure, such as an open umbrella fabric edge. The housing allows for the light source powered by batteries to be activated by the photocell during dark(night) conditions), with the light direction being adjustable underneath. During daylight, the solar cell receives sunlight to charge the batteries within the housing.

8 Claims, 15 Drawing Sheets

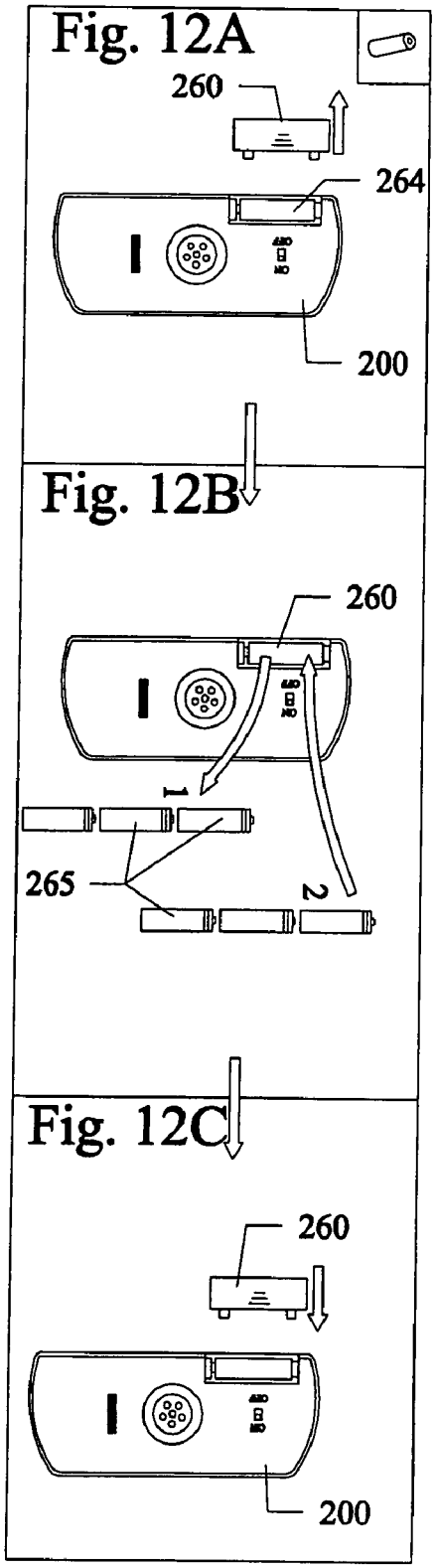
Fig. 12A
260
264
200
Fig. 12B
260
1
265
2
Fig. 12C
260
200
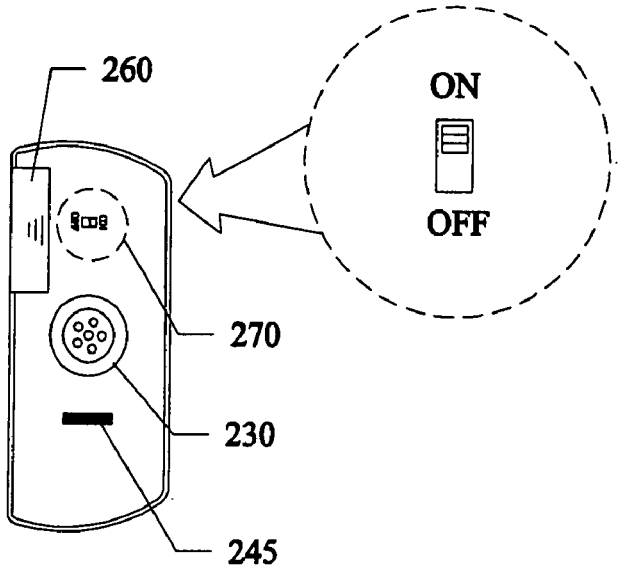
Fig. 12D
260
ON
OFF
270
230
245

SOLAR UMBRELLA CLIP LIGHT

This invention relates to lights, in particular to apparatus, devices and methods of attaching portable solar powered lights to outdoor umbrellas, tree branches, and manmade structures such as but not limited to porches, balconies, gazebos, and the like.

BACKGROUND AND PRIOR ART

Outdoor umbrellas, such as table umbrellas, beach umbrellas and the like, are popular for daytime activities, but can create shadows underneath that take away from their productive use. Furthermore, large table umbrellas, and beach umbrellas are often left in up positions after dark, which makes the space underneath difficult to illuminate. Providing artificial illumination sources such as candles, are easy to use, but must be handled with care since the flames can burn the umbrella. Popular electrically powered lights such as those formed from stringing electrical lines to power small lights and the like, can also be difficult to use, and are not practical in outdoor environments that have no power supplies in close proximity to the umbrellas.

Over the years various light sources have been proposed for lighting umbrellas. See for example, U.S. Pat. Nos. 6,837,255 to Bunch et al. and 7,000,624 to Chang, and U.S. patent applications Ser. No.: 2002/0074027 to Maidment.

The Bunch '255 patent and Chang '624 Published patent application and Maidment '027 published patent application each describes umbrellas with light sources, that requires electrical lines and the light sources be inserted into rib support arms and poles of an umbrella, where the light sources must be carefully inserted into the umbrella parts, and are not easily removable.

U.S. Published patent application Ser. No. 2006/0227540 to Sohn describes a removable clip type light. However, the Sohn publication requires the use of batteries which would not last for long time periods and would need replacement over time. Additionally, the lights point forward, and would not be useful for lighting an area beneath an umbrella. Additionally, the clip part of the light is not expandable and would only be able to slide about a narrow material, such as a hat visor, which is described as an intended use of this light.

Still furthermore, the light sources referenced above are fixed, and cannot be moved to adjust the light beam once the lights are installed in place.

The inventor is not aware of apparatus, devices and methods that overcome all the problems listed above. Thus, the need exists for solutions to the above problems with the prior art.

SUMMARY OF THE INVENTION

A primary objective of the present invention is to provide illumination apparatus, devices and methods of attaching lights to outdoor umbrellas, tree branches, porches, balconies, gazebos, clothes, and the like, that is solar powered.

A secondary objective of the present invention is to provide illumination apparatus, devices and methods of attaching lights to outdoor umbrellas, tree branches, porches, balconies, gazebos, clothes, and the like, having rechargeable batteries.

A third objective of the present invention is to provide illumination apparatus, devices and methods of attaching lights to outdoor umbrellas, tree branches, porches, balconies, gazebos, and the like, that requires no external electrical power supply and wiring to use.

A fourth objective of the present invention is to provide illumination apparatus, devices and methods of attaching lights to outdoor umbrellas, tree branches, porches, balconies, gazebos, and the like, that are portable and easily attachable and detachable.

A fifth objective of the present invention is to provide illumination apparatus, devices and methods of attaching lights to outdoor umbrellas, tree branches, porches, balconies, gazebos, and the like, that is easily attachable and detachable.

A sixth objective of the present invention is to provide illumination apparatus, devices and methods of attaching lights to outdoor umbrellas, tree branches, porches, balconies, gazebos, and the like, where the lights can be adjustably aimed.

A preferred embodiment of the portable light source can consist of a housing having an upper half section with an upper exposed surface, and a lower half section with a bottom exposed surface, an expandable clip for attaching the housing to a narrow support structure, a solar cell mounted in the upper exposed surface of the housing, and a light source located in the bottom exposed surface and being powered by the solar cell, the light source being aimed downward from the housing.

A compartment in the housing with a removable cover can support a removable rechargeable battery, such as double AA batteries, wherein the solar cell allows for the battery to be recharged during daylight hours.

The light source can include light emitting diodes(LEDs), such as white and/or colored LEDS. A focusing lens cover that can include a a dome shaped magnifying lens can be positioned over an exposed portion of the light source. A pivotable/rotatable that can be operated by a turning switch can allow for the base to pivot, which can aim the light beam along an arc direction below the housing.

The expandable clip can include a spring for biasing the clip in a closed position wherein the upper half section is adjacent to the lower half section, the clip having an open position wherein a forward portion of the upper half section and a forward portion of the lower half section are spaced apart from one another. The expandable clip can include an upper handle portion rearwardly extending from the upper half section, a lower handle portion rearwardly extending from the lower handle portion, and a pivot portion for pivotably attaching the upper half section to the lower half section, wherein the spring biases the pivot portion so that the upper half section and the lower half section are in the closed position with the upper half section.

At least one of the upper handle portion and the lower handle portion can have a gripping edge surface such as raised parallel gripping edges.

An on and off switch can be located on the bottom exposed surface of the the lower half section of the housing.

The upper half section of the housing can include a photocell adjacent to a solar cell, wherein the photocell is for activating the light source darkened conditions.

The light source can be clipped about exposed fabric edges of an umbrella.

The light source can be clipped about other structures such as a tree branch.

Novel methods of clipping and unclipping the light source, and activating the light source and recharging battery power supplies are also described.

Further objects and advantages of this invention will be apparent from the following detailed description of the presently preferred embodiments which are illustrated schematically in the accompanying drawings.

BRIEF DESCRIPTION OF THE FIGURES

FIGS. 12A, 12B, 12C, and 12D are bottom views of the clip light with the battery cover being opened, batteries to be inserted inside, battery cover about to be closed and the battery cover in a closed position.

DESCRIPTION OF THE PREFERRED EMBODIMENTS

Figure 1:
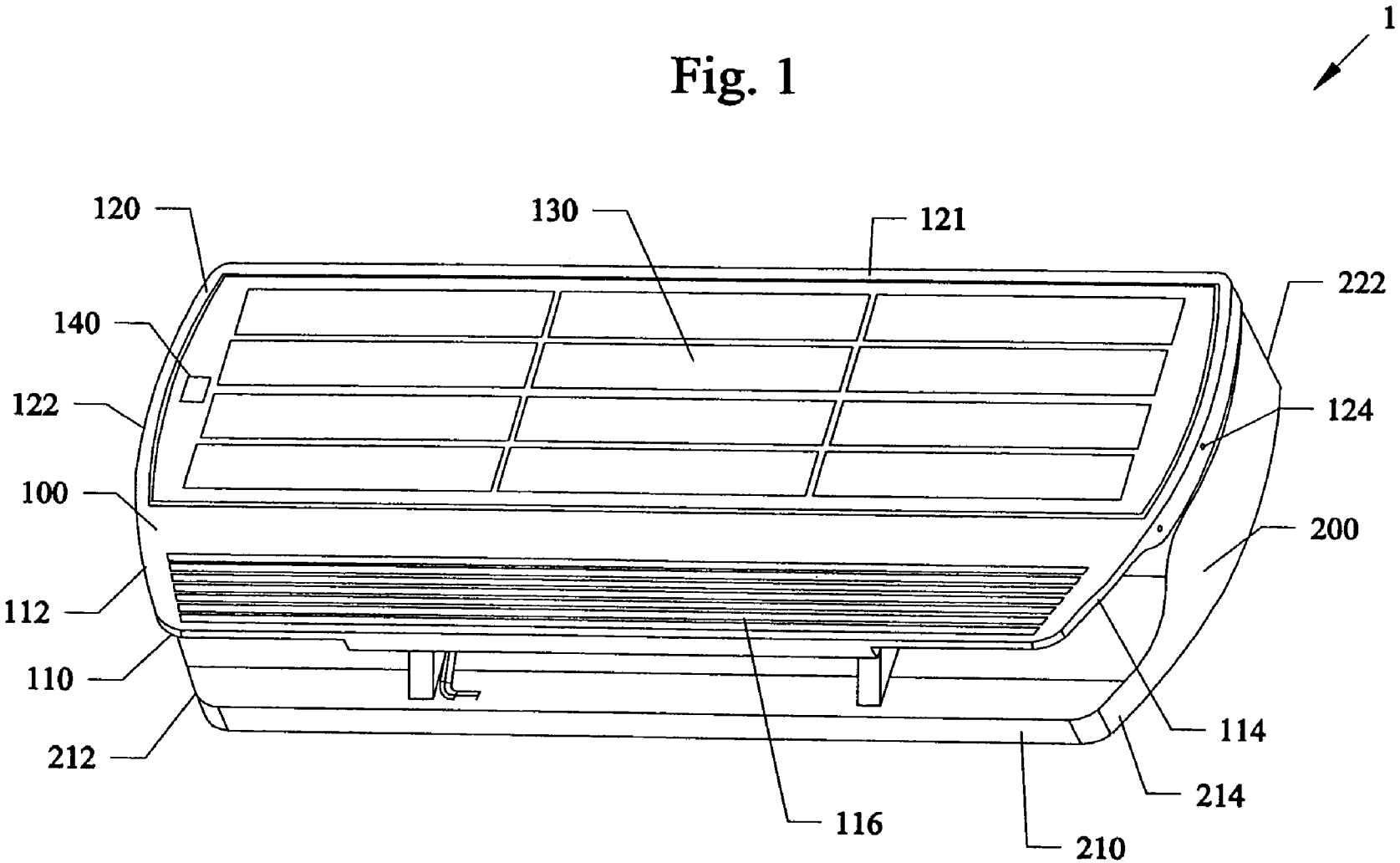
FIG. 1 is a perspective upper rear perspective view of the clip light invention.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A listing of components will now be described.

Housing 1
Upper Half Section 100
Rear end of cover lid 110
Curved side ends 112, 114
Raised or Grooved parallel gripping strips 116 on outer rear end
Pivot attach members for spring 118
Base of cover lid 120
Front end 121
Curved sides 122, 124
Solar panel 130
Photosensor 140
Inside front gripping plate 150
Gripping teeth/strips/grooves 156 on inner front plate
Lower Half Section 200
Rear end of bottom cover 210
Curved side ends 212, 214
Optional raised or grooved parallel gripping strips 216
Pivot attach members for spring 218
Base of cover lid 220
Front end 221
Curved sides 222, 224
Diffuser/lens 230
Light source(s)(LEDs) 235
Tiltable PCB(printed circuit board) base 240
PCB pivot rod 242
Tilting switch/wheel 245
PCB fixer(clip) 246
Interior mount flanges 248
Inside front gripping plate 250
Gripping teeth/strips/grooves 256 on inner front plate
Battery cover 260
Protruding raised edge tips 262
Mateable openings 263
Battery compartment 264
Batteries 265
On/off Switch 270
Spring 300
Pivot rod 350
Umbrella 400
Fabric 410
Edge of fabric 412
Struts 420
Pole 430
Table 440
Legs 450
Branch 500

Figure 2:
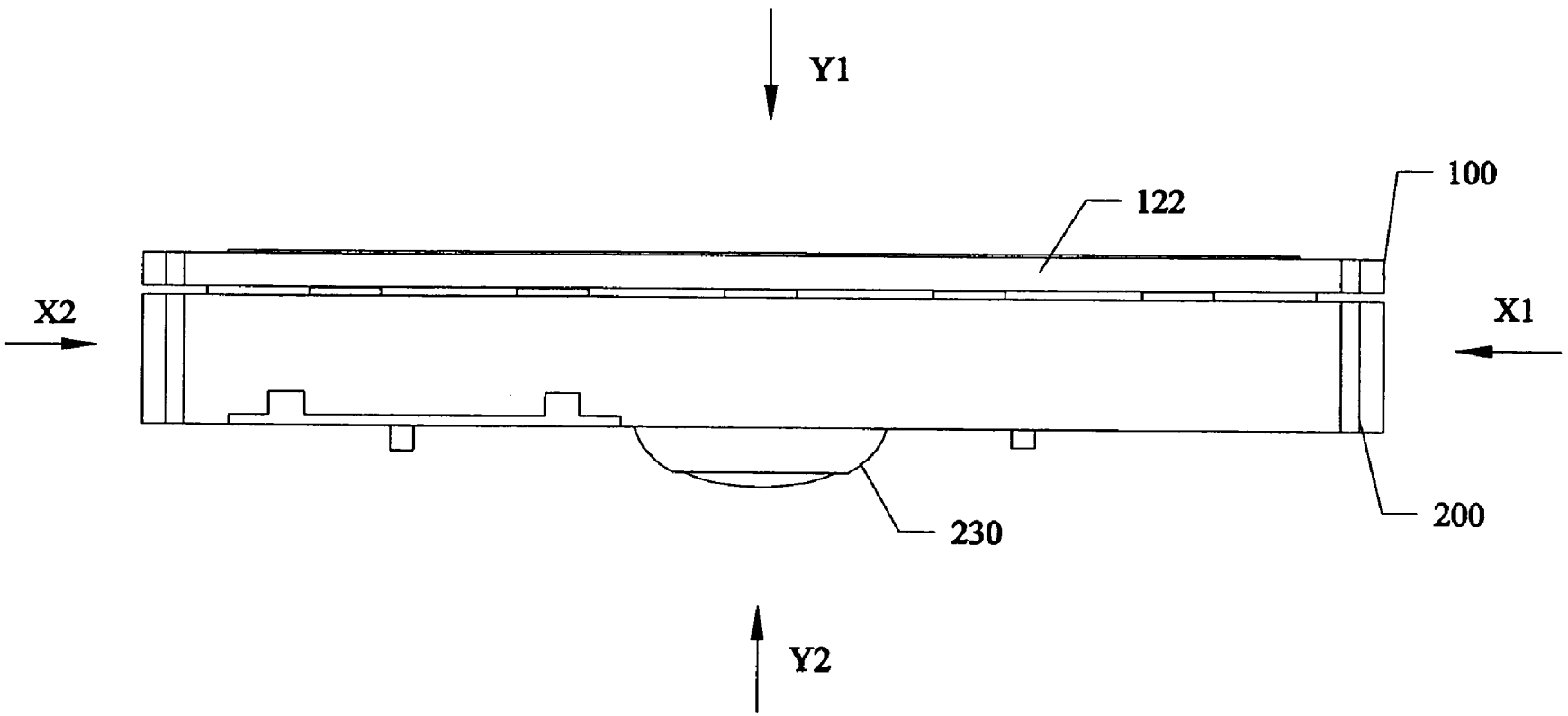
FIG. 2 is a front end view of the clip light of FIG. 1.
Figure 3:
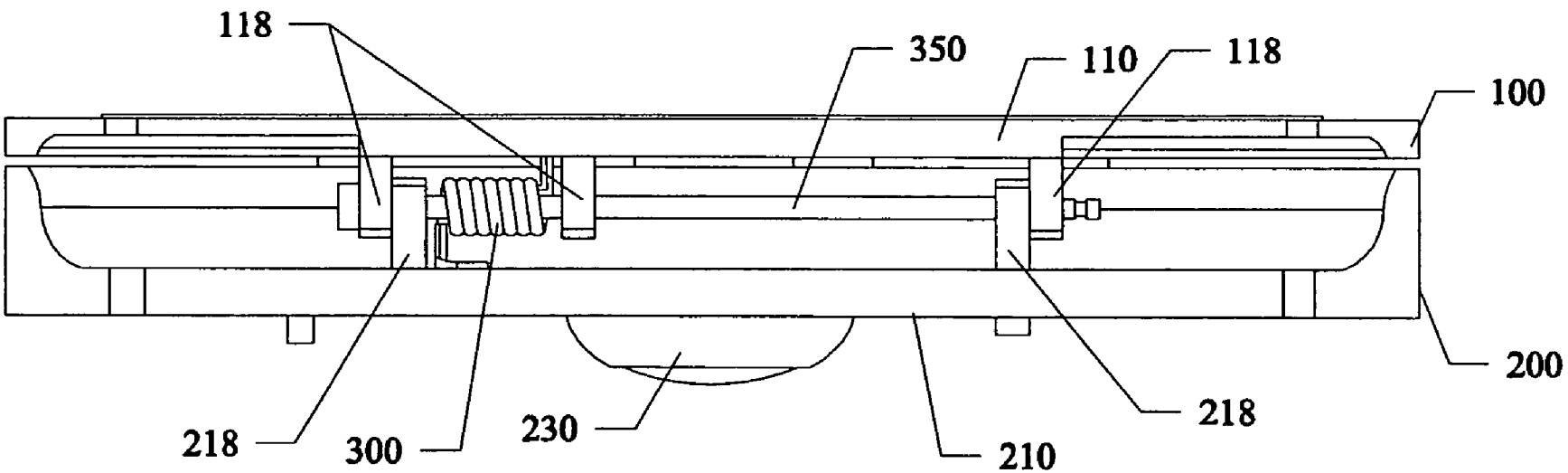
FIG. 3 is a rear end view of the clip light of FIG. 1.
Figure 4:
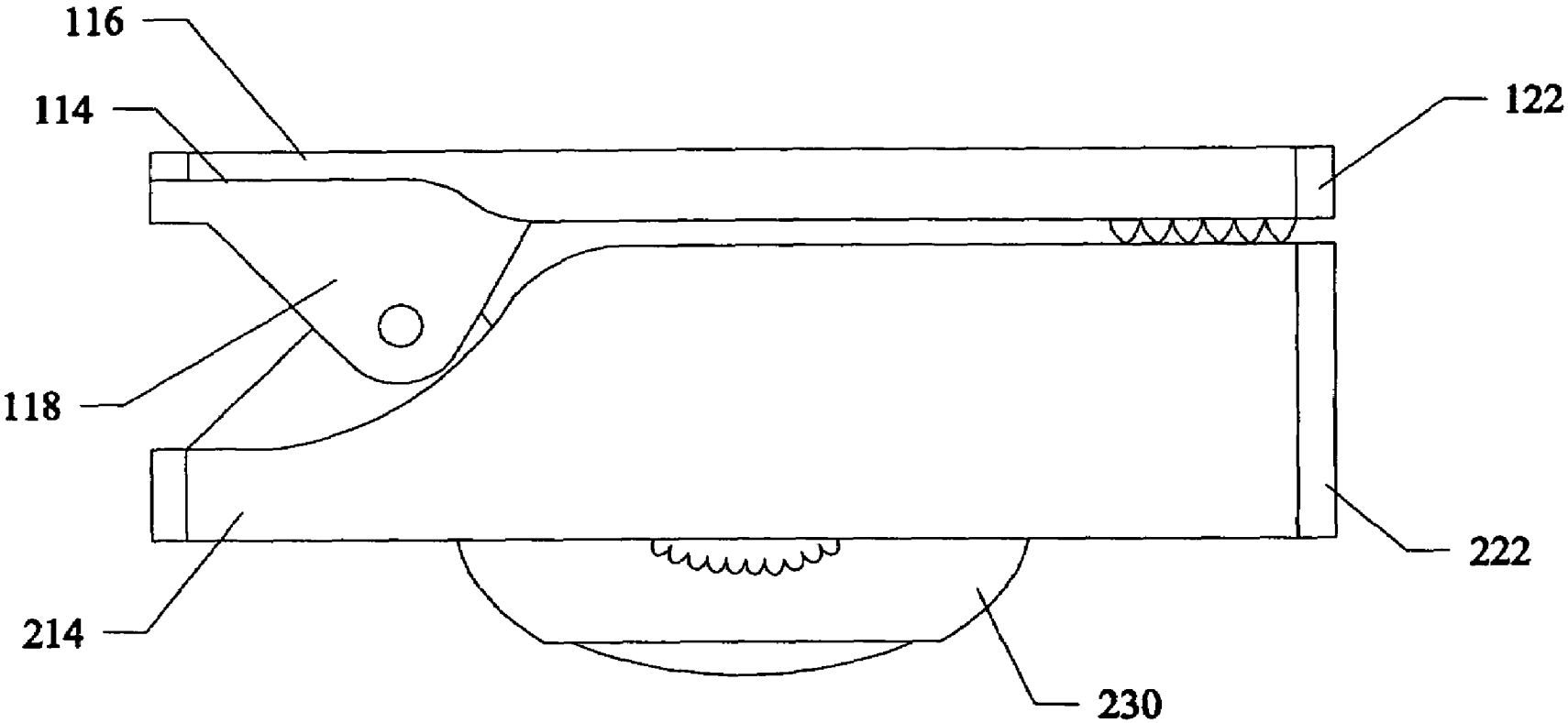
FIG. 4 is a right side view of the clip light of FIG. 2 along arrow X1.
Figure 5:
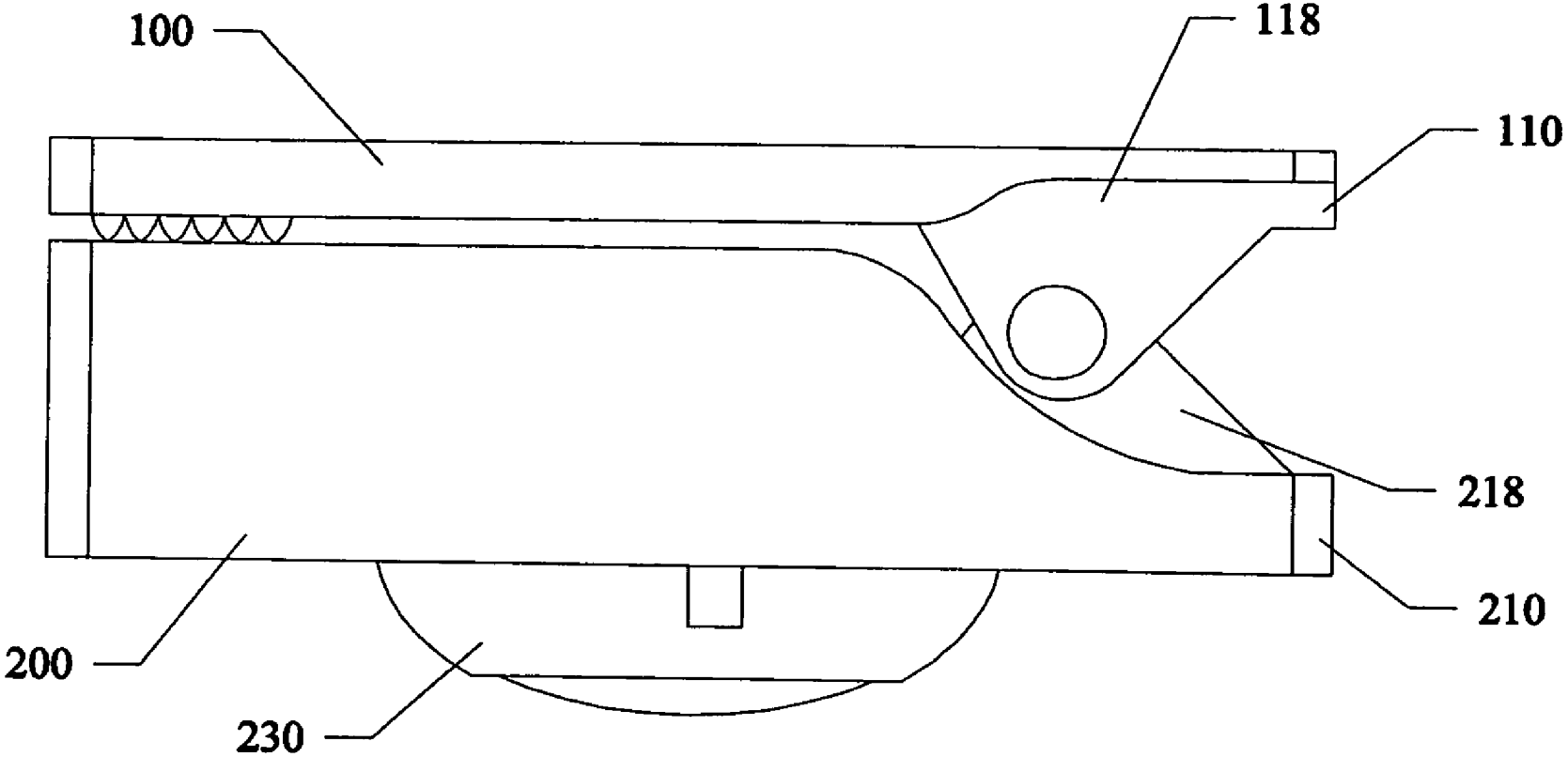
FIG. 5 is a left side view of the clip light of FIG. 2 along arrow X2.
Figure 6:
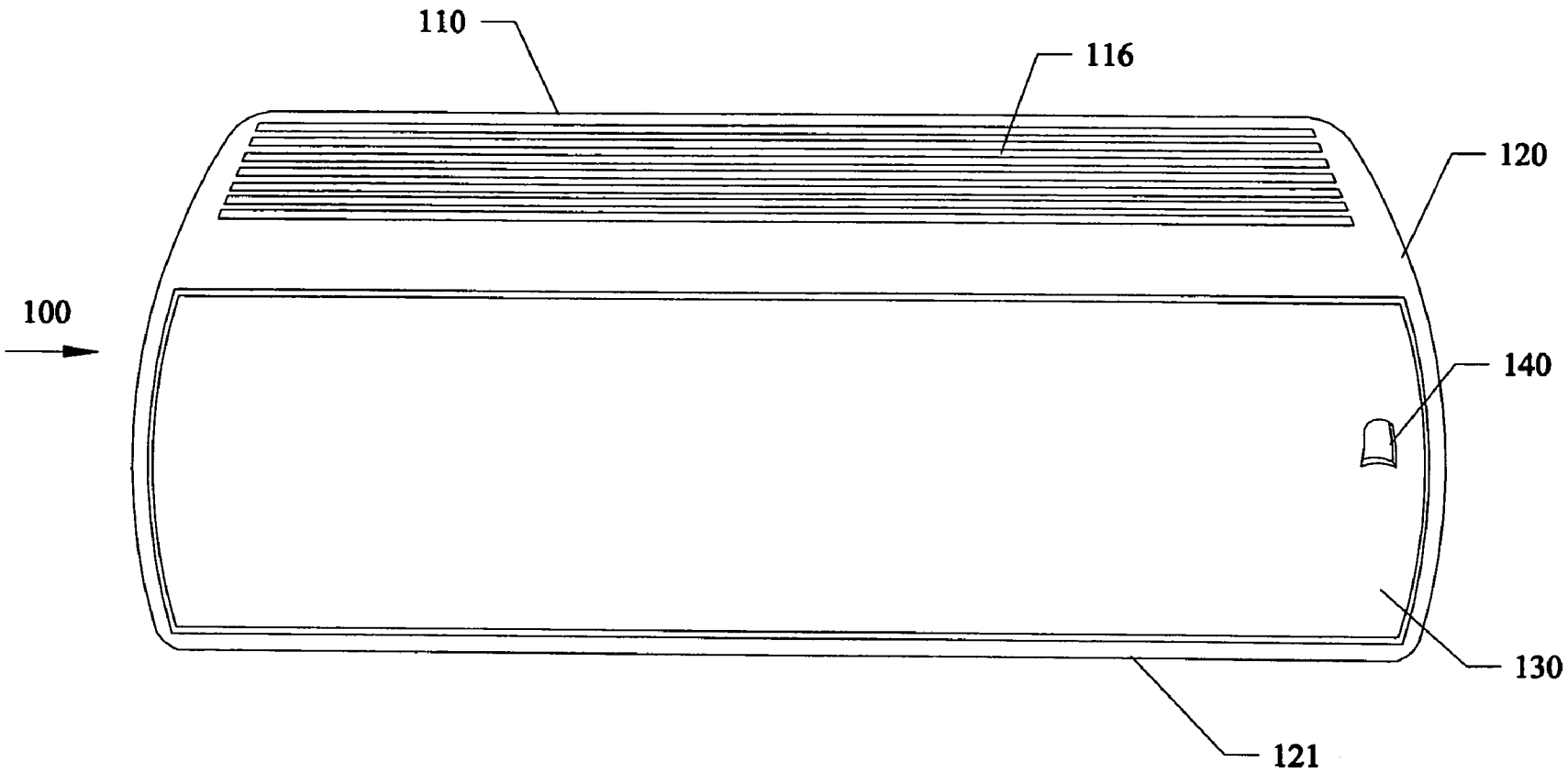
FIG. 6 is a top view of the clip light of FIG. 2 along arrow Y1.
Figure 7:
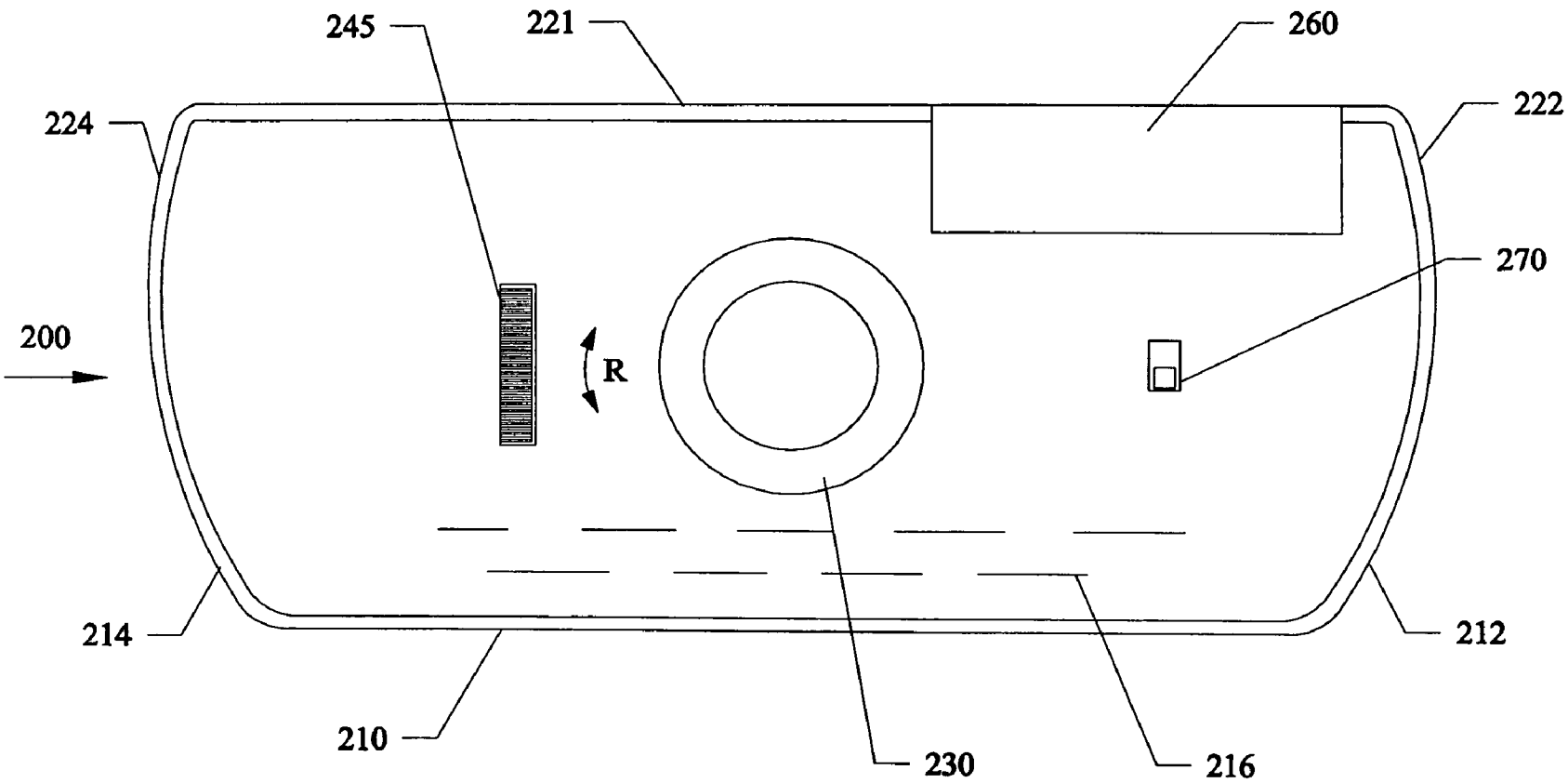
FIG. 7 is a bottom view of the clip light of FIG. 2 along arrow Y2.

FIG. 1 is a perspective upper rear perspective view of the clip light invention 1. FIG. 2 is a front end view of the clip light 1 of FIG. 1. FIG. 3 is a rear end view of the clip light 1 of FIG. 1. FIG. 4 is a right side view of the clip light 1 of FIG. 2 along arrow X1. FIG. 5 is a left side view of the clip light 1 of FIG. 2 along arrow X2. FIG. 6 is a top view of the clip light 1 of FIG. 2 along arrow Y1. FIG. 7 is a bottom view of the clip light 1 of FIG. 2 along arrow Y2.

Referring to FIGS. 1-7, the clip light invention 1, can have a generally rectangular configuration having a front side being approximately 6.75 inches long, a rear side being approximately 6 inches long, and a width of approximately 3 inches wide, and a thickness of approximately 1 inch thick, with an overall weight of approximately 7.8 ounces, which makes the device both compact and lightweight. The clip light device 1 includes an upper half section 100 pivotally attached to a lower half section 200, by upper half pivot flange members 118 and lower half pivot flange members 218 with a spring 300 therebetween on a pivot rod 350(that passes through flange members 118, 218). The spring 300 biases the rear end 110 of the upper half section apart 100 from the rear end 210 of the lower half section 200 so that the clip light is in a closed position, which will be more fully described below.

The upper half section 100 forms a cover lid with a front end 121, curved front sides 122, 124 that each connect to respective rear curved side ends 112, 114 and a rear end 110. Across a rear outer surface of the upper half section 100 can be a gripping surface 116, that can include raised parallel narrow strips, or parallel grooved indentations. Across another outer surface portion 120 of the upper half section 100 can be a solar panel 130, which can run substantially across the length of the clip light 1 and have a length of approximately 6.67 inches by approximately 2 inches wide. A photosensor 140 can also be located in the outer surface portion 120.

The lower half section 200 forms a bottom lid with a front end 221, curved front sides 222, 224 that each connect to respective rear curved side ends 212, 214 and a rear end 210. An optional gripping surface 216 can be provided across rear outer surface of the lower half section 200, which is similar to the upper gripping surface 116. Extending downward from the lower half section can be a diffuser/lens 230 that covers a light source 235, such as light emitting diodes 235. The diffuser/lens can have a somewhat dome shape that generally focuses a light beam that emits from the light source 235. Also on the outer surface of the bottom lid can be a rotatable switch 245 which adjusts a tilt angle of the light source 235 so that rotating the switch tilts the light source to emit beams along different arc directions of an approximately 145 degrees.

Also on the outer surface of the bottom lid can be a battery cover 260 that can be a snapable and/or pivotal cover that closes a battery compartment 264 thereunder. A power switch 270 such as but not limited to a toggle switch can turn on and turn off power to the light source 235.

Figure 8:
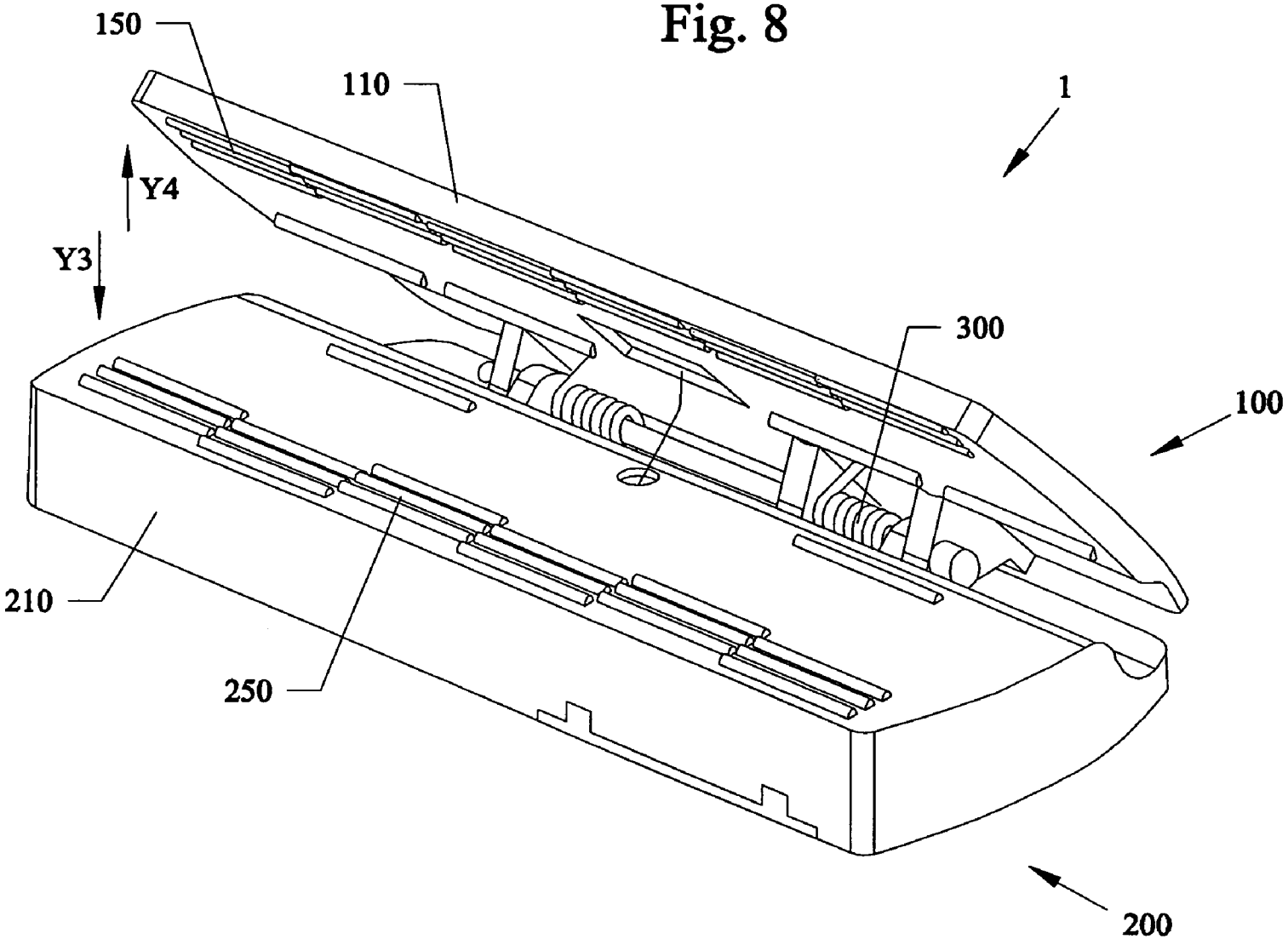
FIG. 8 is a perspective front view of the clip light of the above figures in an open position.
Figure 9:
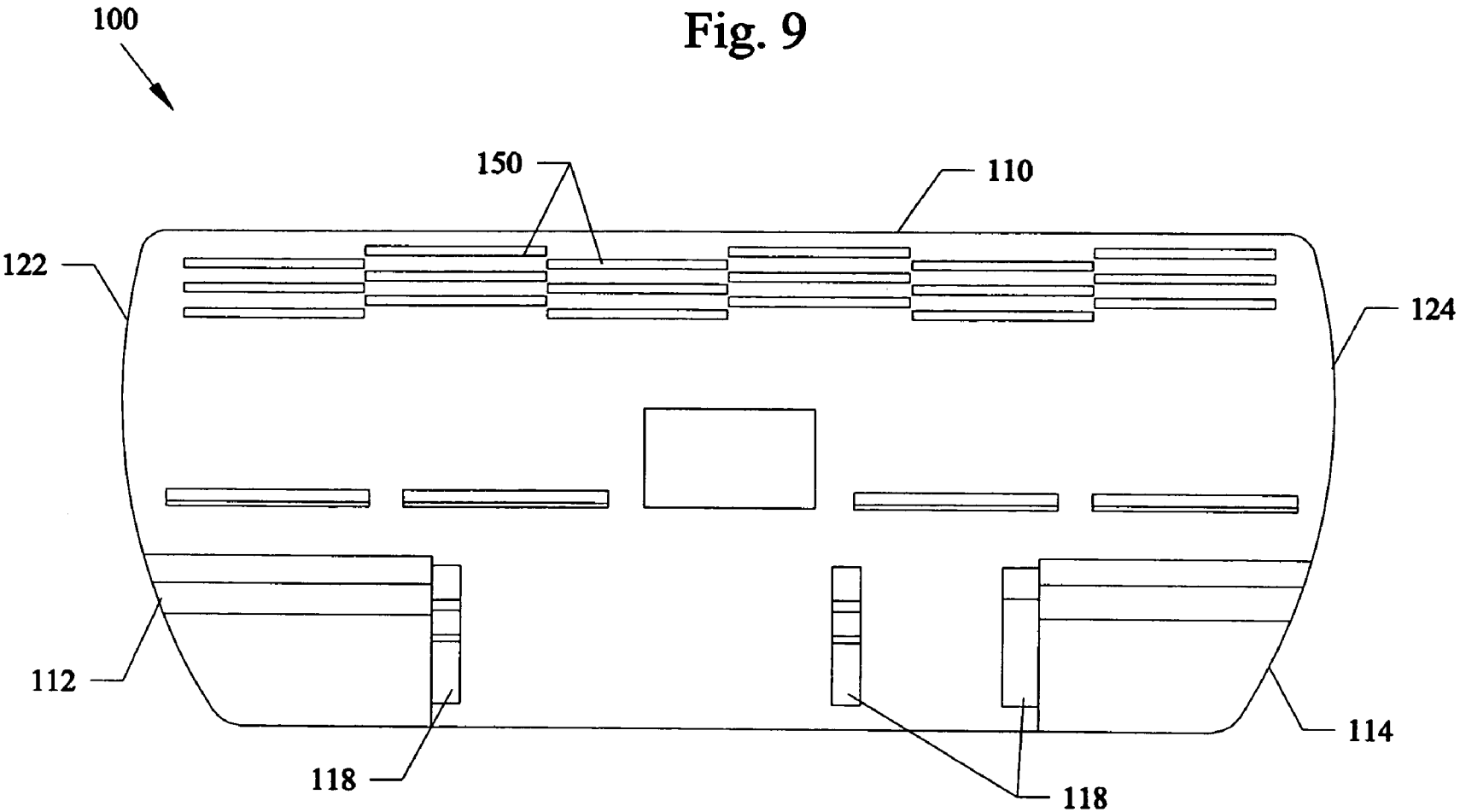
FIG. 9 is a top inside view of the open clip light of FIG. 8 along arrow Y4.
Figure 10:
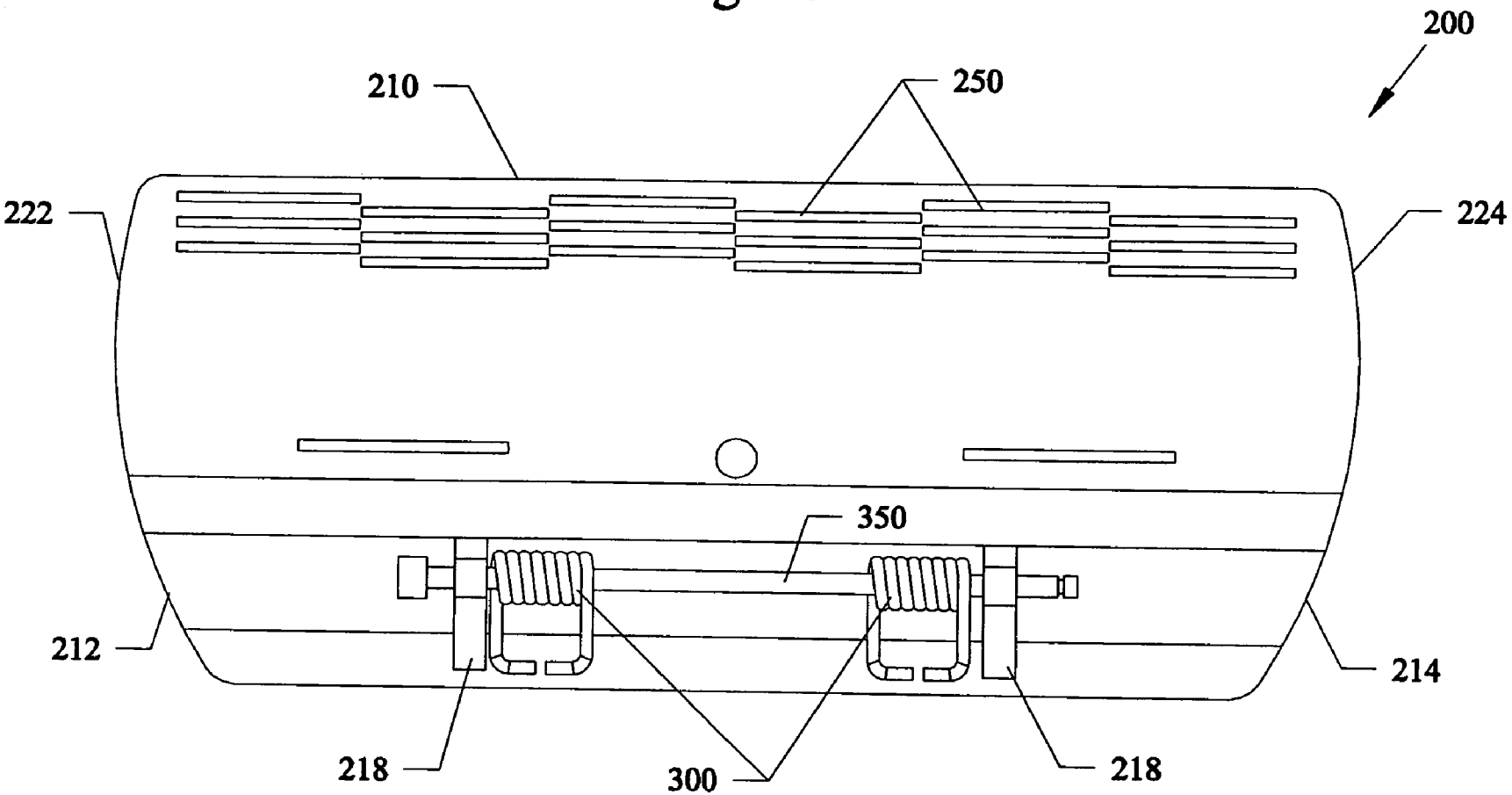
FIG. 10 is a bottom inside view of the open clip light of FIG. 8 along arrow Y3.
Figure 11:
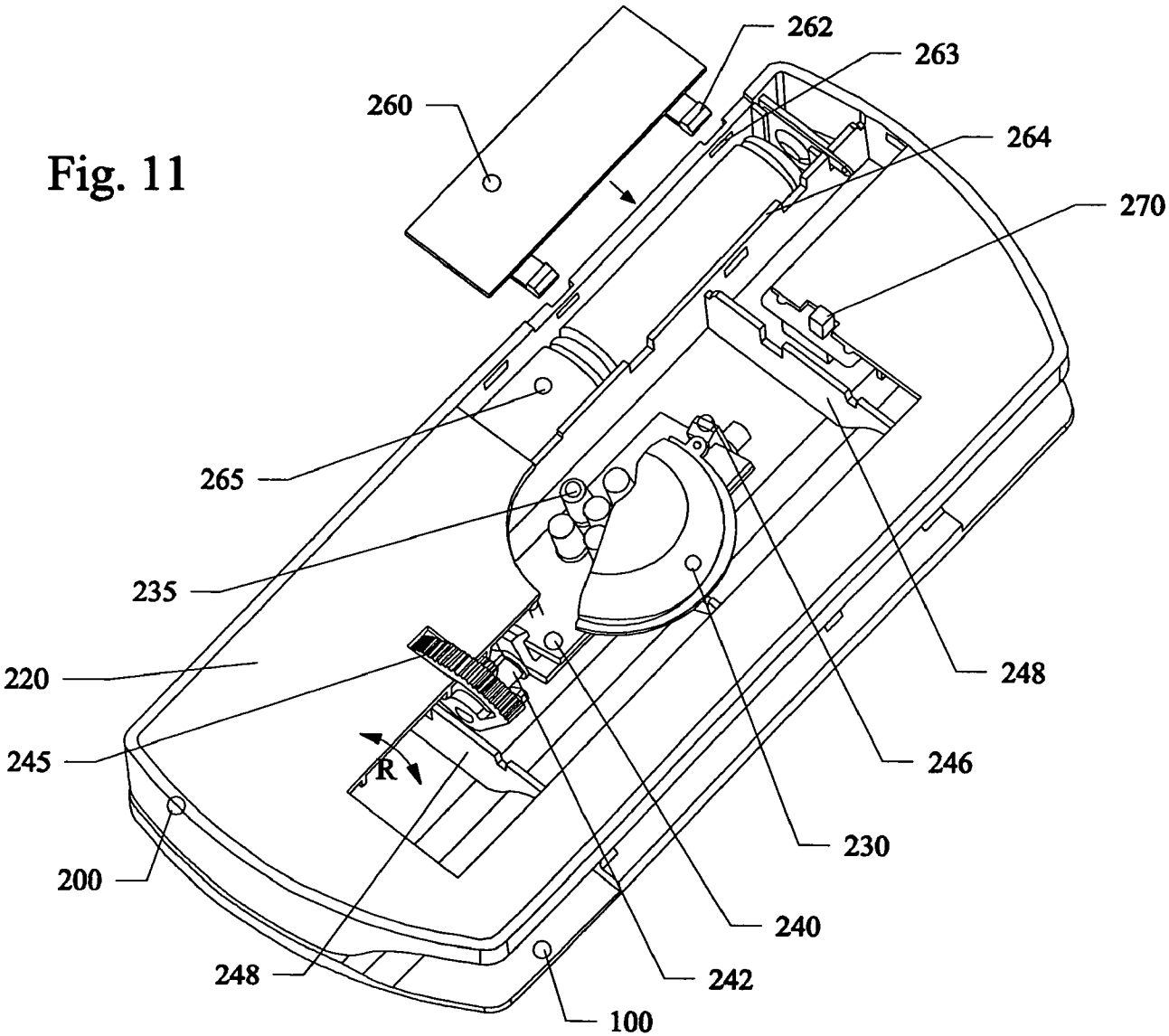
FIG. 11 is a partial cross-sectional bottom view of the clip light of the above figures.

FIG. 8 is a perspective front view of the clip light 1 of the above figures in an open position. FIG. 9 is a top inside view of the open clip light 1 of FIG. 8 along arrow Y4. FIG. 10 is a bottom inside view of the open clip light 1 of FIG. 8 along arrow Y3. FIG. 11 is a partial cross-sectional bottom view of the clip light 1 of the above figures.

FIGS. 12A, 12B, 12C, and 12D are bottom views of the clip light 1 with the battery cover 260 being opened, batteries 265 to be inserted inside, battery cover 260 about to be closed and the battery cover 260 in a closed position. Referring to FIGS. 11-12D, the battery cover 260 can slide into place with protruding raised edge tips 262 that snap into mateable openings 263 in the bottom half section 200. The battery cover can also be pivotally attached to snap into place to cover battery compartment 264.

Referring to FIGS. 8-12D, upper half section 100 can include an inside front gripping plate 150. Lower half section 200 can include an inside front gripping plate 250. The gripping plates 150, 250 can include parallel raised offset rib members that interlock within one another so that the housing 1 in a closed position can wrap about a support surface, such as an umbrella material which will be described in detail later.

Referring to FIGS. 7 and 11, inside the lower half section 200 a light source 235, such as but not limited to a LED(light emitting diode(s)) can be mounted on a printed circuit board (pcb) 240. The opposite ends of the pcb 240 can be attached to a pcb pivot rod 242 by a pair of pcb fixers(clips) 246. Interior mount flanges 248 inside the lower half section 200 can support outer ends of the rotatable pivot rod 242. A tilting mechanism 245, such as but not limited to a tilting switch/wheel having raised outer raised grooves. A diffuser/lens 230 such as a dome shaped lens can be fixably mounted about an exterior opening in the lower half section 200 above the light source 235. The diffuser/lens 230 can focus the light emissions from the light source 235.

The operation of the clip device 1 will now be described in reference to FIGS. 1-12D. An operator can turn on power from batteries 265 to the light source 235 in the device 1 by power switch 270 with the light source being activated by the photosensor 140. When the power switch 270 is in an on position, lack of daylight(night-time conditions) can be detected by a top located photosensor 140, which will then turn the light source 235 on. The batteries 265 can be charged from sunlight that strikes the solar panel 130 during daylight hours, and the photosensor 140 does not activate the light source 235.

When the light source 235 is in an on position, the user can rotate the tilting mechanism 245 exposed from the bottom of the housing 1, in arc direction along arrow R, which rotates pivot rod 242 and pcb 240 supported light source 235 to direct a focused light beam from diffuser/lens 230.

Figures 13, 14:
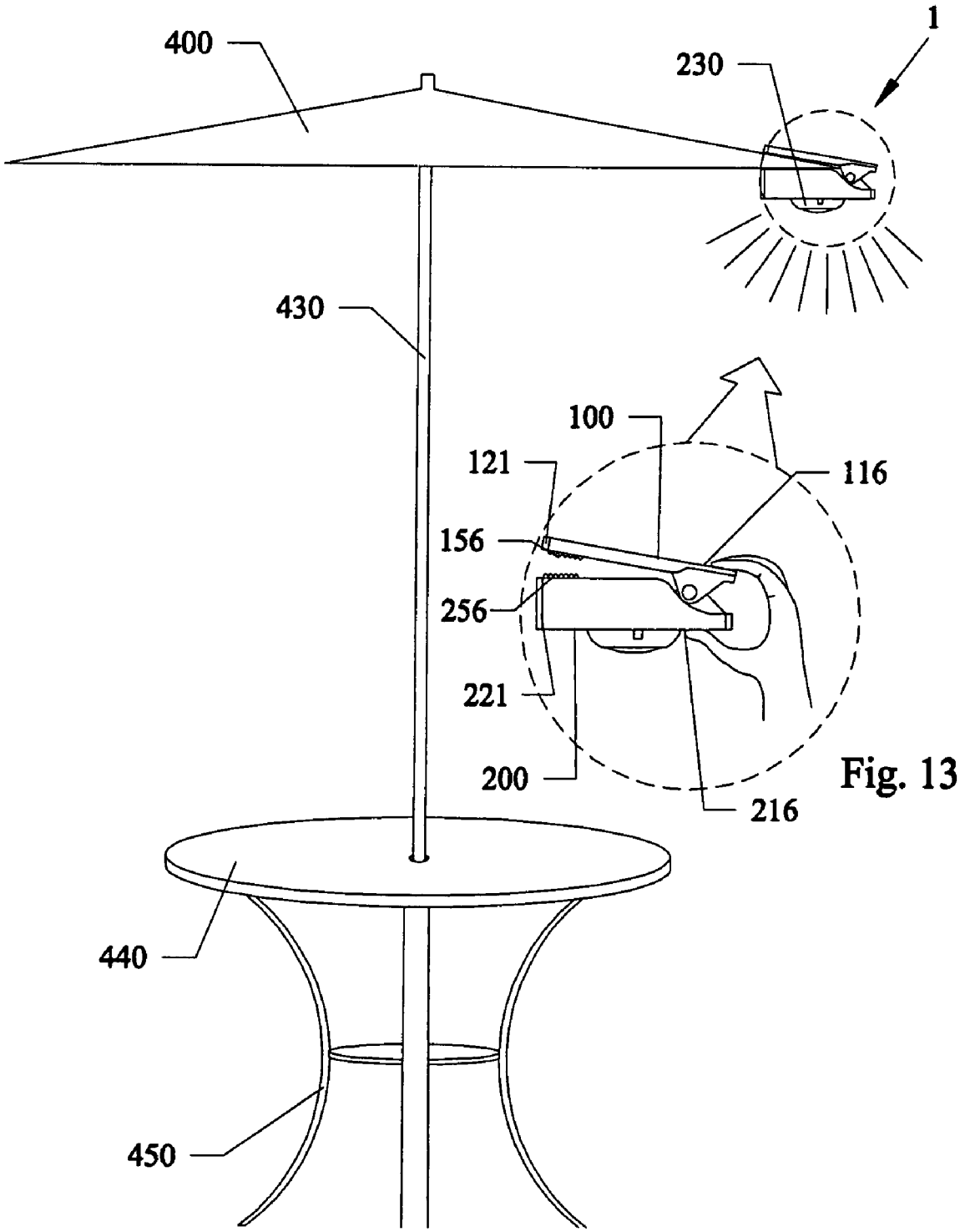
FIG. 13 is a side view of the clip light being opened to attach to an underlying structure.
FIG. 14 is a side view of the clip light attached to an umbrella.

FIG. 13 is a side view of the clip light 1 being opened to attach to an underlying structure. An operator can press on portions 116, 216 of the clip light to expand front ends 121 of upper half section 100 from front end 221 of lower half section 200.

Figure 15:
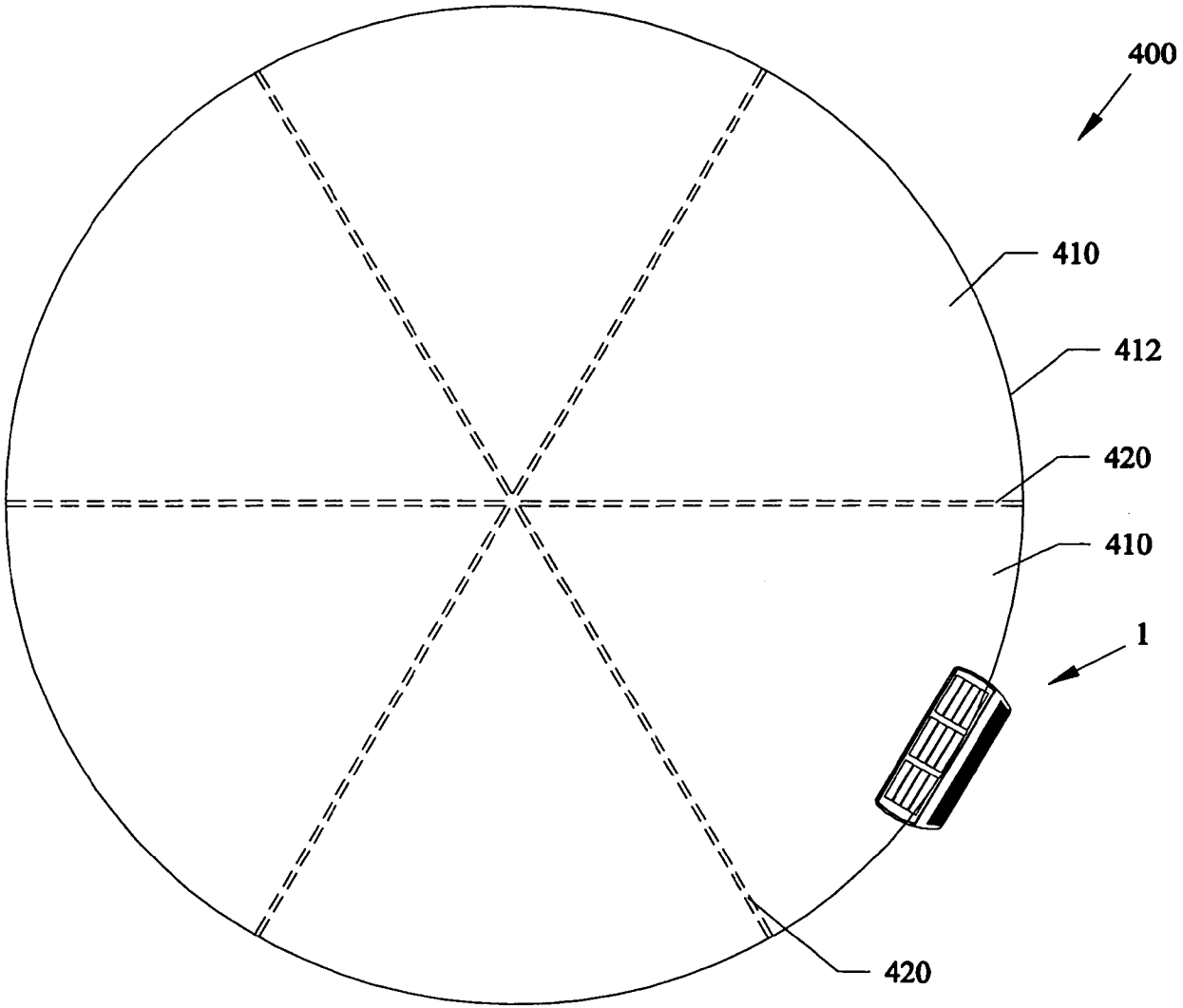
FIG. 15 is a top view of the umbrella with attached clip light of FIG. 14.

FIG. 14 is a side view of the clip light attached to an umbrella 400. FIG. 15 is a top view of the umbrella 400 on pole 430 with table 440 that is supported above ground surface by table legs 450, with the attached clip light 1 of FIG. 14. Here, the opened clip light 1 can wrap about fabric edge 412 of the umbrella fabric 410 between struts 420. The upper gripping teeth 156 of upper half section 100 and the lower gripping teeth 256 of lower half section 200 can sandwich a portion of the umbrella fabric 410 therebetween. Adjusting the arc direction of the light 235 by the switch 245, previously described, can beam the light emission to a selected location beneath the umbrella 400. The operator can remove the clip light by compressing portions 116, 216 of the clip light 1 and pulling the clip light 1 away from the umbrella 400.

Figure 16:
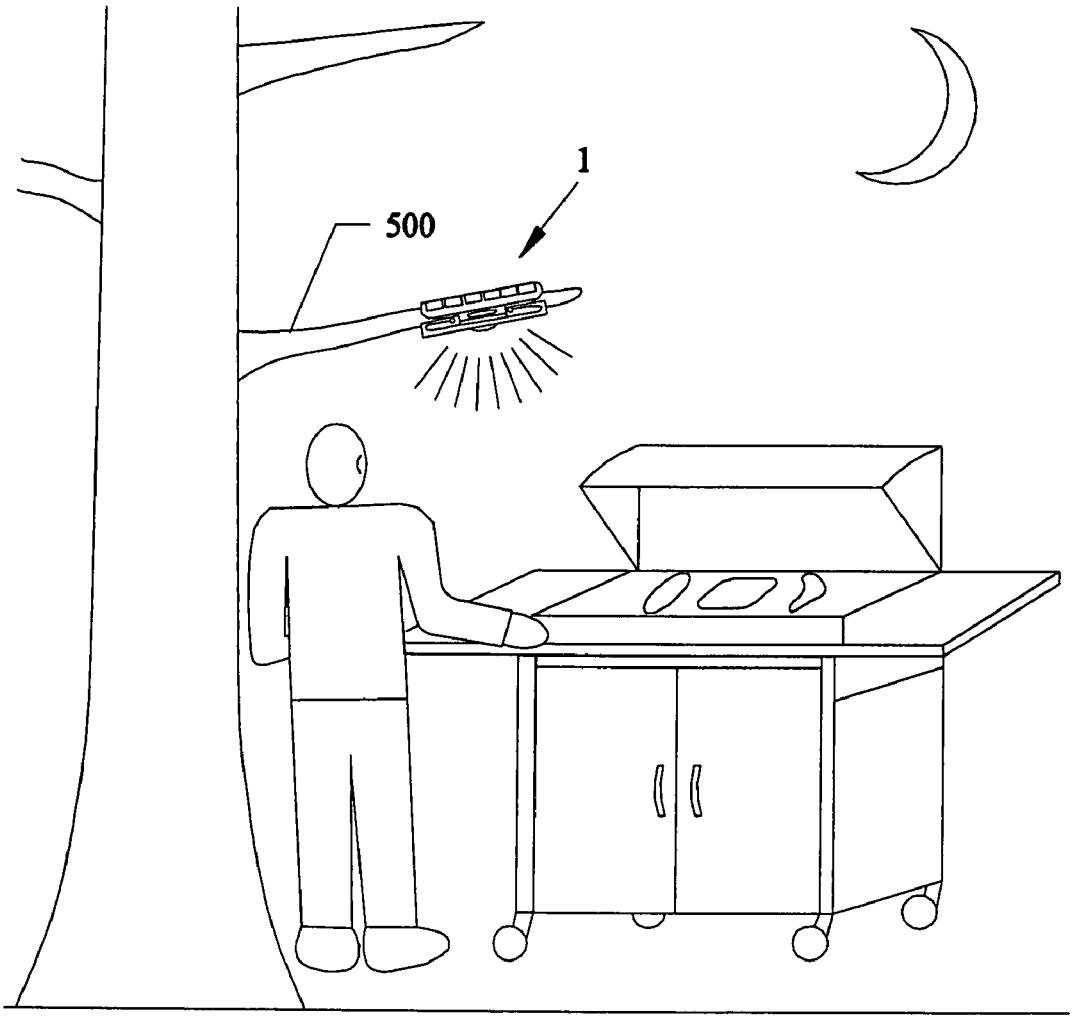
FIG. 16 is a side view of the clip light attached to a branch of a tree.

FIG. 16 is a side view of the clip light 1 attached to a branch of a tree 500 so that a light source can be used during night-time conditions and allow for outdoor activities to be visible, such as during a barbeque, and the like.

The clip light 1, can also be attached to other structures such as but not limited to attaching to a visor in a vehicle, such as an automobile, truck, and the like, as needed.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A portable light source, comprising:

a housing having an upper half section with an upper exposed surface and a lower surface, and a lower half section with a bottom exposed surface and an upper surface, the lower surface of the upper half section having a front portion with a generally planar surface with parallel rows of raised rib members, and the upper surface of the lower half section having a front portion with a generally planar surface with parallel rows of raised rib members, the upper exposed surface of the upper half section and the bottom exposed surface of the lower half section each being flat and planar, the upper exposed surface of the upper half section and the bottom exposed surface of the lower half section being parallel to one another, the bottom exposed surface of the lower half section having an circular opening and a rectangular opening both therethrough into an inside of the lower half section;

an expandable clip having a spring for biasing the housing in a closed position wherein the upper half section is adjacent to the lower half section, the housing having an open position wherein a forward portion of the upper half section and a forward portion of the lower half section are spaced apart from one another, the expandable clip for attaching the housing to a narrow support structure, where the parallel rows of raised rib members of the upper half section interlock with and between the parallel rows of raised rib members of the lower half section when the housing is in the closed position, the expandable clip including an upper handle portion and a lower handle portion, the upper handle portion rearwardly extending from the upper half section, the upper handle having opposing angled sides that narrow a width of the upper handle portion to a rear edge of the upper handle portion, the lower handle portion rearwardly extending from the lower half handle portion, the lower handle portion having opposing angled sides that narrow a width of the upper handle portion to a rear edge of the lower handle portion, and a pivot portion located between the upper handle portion and the lower handle portion, the pivot portion being located between the rear edges of the upper handle portion and the lower handle portion, and a midportion of the housing, the pivot portion for pivotably attaching the upper half section to the lower half section, wherein the spring biases the pivot portion so that the upper half section and the lower half section are in the closed position with the upper half section;

a solar cell mounted in the upper exposed surface of the housing;

a removable and rechargeable battery inside of the housing, the battery being charged by the solar cell;

a light source in the circular opening having a plurality of (light emitting diodes)LEDs with outer ends extending below the circular opening in the bottom exposed surface of the lower half section, and upper ends extending above the bottom exposed surface of the lower half section;

a pivotable base for mounting the upper ends of the LEDs thereon, the moveable base being mounted above the circular opening in the bottom exposed surface of the lower half section, the LEDS being powered by the removable and rechargeable battery, the light source of the LEDs being aimed downward from the bottom exposed surface of the lower half section of the housing;

a dome shaped magnifying lens covering about the outer ends of the LEDs, the dome shaped magnifying lens attached to and completely covering the circular opening in the bottom exposed surface of the lower half section;

a rotatable wheel with serrated edges mounted in the rectangular opening in the bottom exposed surface of the lower half section, the rotatable wheel attached to the lower half section by a pivot rod axis inside the lower half section, the pivot rod axis being attached to the pivotable base, the wheel having an upper portion which remains above the bottom exposed surface of the lower half section, and a lower portion which remains exposed out of the rectangular opening and beneath the bottom exposed surface of the lower half section, wherein rotating the wheel switch by exposed portions of the serrated edges of the wheel rotates the light source to aim the light source along different arc directions downward from the bottom exposed surface of the lower half section of the housing; and a photocell on the upper exposed surface of the upper half section of the housing for activating the light source during dark environmental conditions.

2. The light source of claim 1, further comprising:

a compartment in the housing with an exterior opening;

a snapable lid for covering the opening to the compartment, wherein the removable rechargeable battery is inside of the compartment.

3. The light source of claim 1, further comprising:

an on and off switch on the bottom exposed surface of the lower half section of the housing.

4. The light source of claim 1 wherein the support structure includes:

an outer perimeter fabric edge of an opened umbrella.

5. The light source of claim 1, wherein the support structure includes:

a tree branch.

6. The light source of claim 1, wherein the parallel rows of the raised rib members in the front portion of the upper half section include sets of rows that are offset with one another, and the parallel rows of the raised rib members in the front portion of the lower half section include sets of rows that are offset with one another, so that the sets of the offset rows allows for an enhanced interlocking with and between all the raised members when the housing is in the closed position.

7. A removable light source system for illuminating areas underneath raised umbrellas, comprising in combination:

an umbrella with fabric, collapsible ribs and support pole, the umbrella having a raised expanded position with the fabric stretched between the ribs, and the umbrella having a closed retracted position with the fabric folded adjacent to the ribs, the fabric having exposed outer edges along an outer perimeter when the umbrella is in the raised expanded position;

a housing having an upper half section with upper exposed surface and a lower half section with a lower exposed surface, the upper half section having a lower surface with a front generally planar portion having parallel rows of narrow gripping members, the lower half section having an upper surface with a front generally planar portion having parallel rows of narrow gripping members, the upper exposed surface of the upper half section and the bottom exposed surface of the lower half section each being flat and planar, the upper exposed surface of the upper half section and the bottom exposed surface of the lower half section being parallel to one another, the bottom exposed surface of the lower half section having a circular opening and rectangular opening therethrough into an inside of the lower half section;

a spring biased clip for attaching the front portions of the upper half section and the lower half section of the housing onto the exposed outer perimeter edges of the fabric solely when the umbrella is in a raised expanded position, so that the parallel rows of the gripping members of the upper half section interlock with and between the parallel rows of the gripping members of the lower half section of the housing, the spring biased clip including an upper handle portion and a lower handle portion, the upper handle portion rearwardly extending from the upper half section, the upper handle having opposing angled sides that narrow a width of the upper handle portion to a rear edge of the upper handle portion, the lower handle portion rearwardly extending from the lower half handle portion the lower handle portion having opposing angled sides that narrow a width of the upper handle portion to a rear edge of the lower handle portion, and a pivot portion located between the upper handle portion and the lower handle portion, the pivot portion being located between the rear edges of the upper handle portion and the lower handle portion, and a midportion of the housing, the pivot portion for pivotably attaching the upper half section to the lower half section, wherein a spring biases the pivot portion so that the upper half section and the lower half section are in the closed position with the upper half section;

a solar cell on the upper surface of the housing;

a removable and rechargeable battery inside of the housing, the battery being charged by the solar cell; and a light source in the circular opening having a plurality of (light emitting diodes)LEDs with outer ends extending below the circular opening in the bottom exposed surface of the lower half section, and upper ends extending above the bottom exposed surface of the lower half section;

a pivotable base for mounting the upper ends of the LEDs thereon, the moveable base being mounted above the circular opening in the bottom exposed surface of the lower half section, the LEDs being powered by the removable and rechargeable battery the light source of the LEDs being aimed downward from the bottom exposed surface of the lower half section of the housing;

a dome shaped magnifying lens covering about the outer ends of the LEDs, the dome shaped magnifying lens attached to and completely covering the circular opening in the bottom exposed surface of the lower half section;

a rotatable wheel with serrated edges mounted in the rectangular opening in the bottom exposed surface of the lower half section, the rotatable wheel attached to the lower half section by a pivot rod axis inside the lower half section, the pivot rod axis being attached to the pivotable base, the wheel having an upper portion located above the rectangular opening in bottom exposed surface of the lower half section, and a lower portion which remains exposed out of the rectangular opening and beneath the bottom exposed surface of the lower half section, wherein rotating the wheel switch by exposed portions of the serrated edges of the wheel rotates the light source to aim the light source along different arc directions downward from the bottom exposed surface of the lower half section of the housing, the light source for illuminating an area directly beneath the umbrella; and a photocell on the upper exposed surface of the upper half section of the housing for activating the light source during dark environmental conditions.

8. The removable light source system of claim 7, wherein the parallel rows of the narrow gripping members in the front portion of the upper half section include sets of rows that are offset with one another, and the parallel rows of the narrow gripping members in the front portion of the lower half section include sets of rows that are offset with one another, so that the sets of the offset rows allows for an enhanced interlocking with and between all the narrow gripping members when the housing is in the closed position.

* * * * *